US010156007B2

(12) United States Patent
Tang et al.

(10) Patent No.: US 10,156,007 B2
(45) **Date of Patent: *Dec. 18, 2018**

(54) METHODS OF APPLYING CHROMIUM DIFFUSION COATINGS ONTO SELECTIVE REGIONS OF A COMPONENT

(71) Applicants: Zhihong Tang, Carmel, IN (US); Kevin E Garing, Indianapolis, IN (US); Thomas D Findlay, Lincoln (GB); Thomas F Lewis, III, Zionsville, IN (US); James K Knapp, Pittsboro, IN (US); Jeffrey J McConnell, North Waterboro, ME (US)

(72) Inventors: Zhihong Tang, Carmel, IN (US); Kevin E Garing, Indianapolis, IN (US); Thomas D Findlay, Lincoln (GB); Thomas F Lewis, III, Zionsville, IN (US); James K Knapp, Pittsboro, IN (US); Jeffrey J McConnell, North Waterboro, ME (US)

(73) Assignee: PRAXAIR S.T. TECHNOLOGY, INC., North Haven, CT (US)

( * ) Notice: Subject to any disclaimer, the term of this patent is extended or adjusted under 35 U.S.C. 154(b) by 10 days.

This patent is subject to a terminal disclaimer.

(21) Appl. No.: 15/415,395

(22) Filed: Jan. 25, 2017

(65) Prior Publication Data

US 2017/0198382 A1 Jul. 13, 2017

Related U.S. Application Data

(63) Continuation of application No. 14/592,382, filed on Jan. 8, 2015, now Pat. No. 9,587,302.

(Continued)

(51) Int. Cl.

*C23C 16/06* (2006.01)
*C23C 10/10* (2006.01)

(Continued)

(52) U.S. Cl.

CPC ..... *C23C 10/10* (2013.01); *C23C 10/04* (2013.01); *C23C 10/14* (2013.01); *C23C 10/20* (2013.01);

(Continued)

(58) Field of Classification Search

CPC ..... C23C 16/06; C23C 16/10; C23C 16/14

See application file for complete search history.

(56) References Cited

U.S. PATENT DOCUMENTS 3,632,407 A * 1/1972 Bungardt ..... C23C 10/14 427/253
3,764,371 A * 10/1973 Baldi ..... C23C 10/38 148/240

(Continued)

FOREIGN PATENT DOCUMENTS

EP 0984074 A1 3/2000
EP 1788125 A2 5/2007

(Continued)

OTHER PUBLICATIONS

Tsvikilevych, O.S., et al., "Structure and Properties of a Chromium Diffusion Coating on the Inner Surface of 08Kh13G14N4 Steel Pipes". Materials Science, vol. 29, No. 5, 1993, pp. 473-477.*

(Continued)

*Primary Examiner* — Bret P Chen
(74) *Attorney, Agent, or Firm* — Nilay S. Dalal

(57) ABSTRACT

Unique and improved chromizing processes are disclosed. The processes involve forming localized chromizing coatings onto selected regions of a substrate. The chromium diffusion coatings are locally applied to selected regions of substrates in a controlled manner, in comparison to conventional chromizing processes, and further in a manner that produces less material waste and does not require diffusion-stop-off masking. Prior to or after a localized slurry chromiz- (Continued)

ing process of the present invention, a layer of a platinum-group-metal (PGM) is applied to produce a PGM-modified chromium diffusion coating onto selected regions of a substrate. A second coating can be selectively applied onto other regions of the substrate.

17 Claims, 4 Drawing Sheets

Related U.S. Application Data

(60) Provisional application No. 61/927,210, filed on Jan. 14, 2014.

(51) Int. Cl.

| | |
|---|---|
| ***C23C 10/14*** | (2006.01) |
| ***C23C 10/04*** | (2006.01) |
| ***C23C 10/60*** | (2006.01) |
| ***C23C 10/20*** | (2006.01) |
| ***C23C 10/32*** | (2006.01) |
| ***C23C 10/50*** | (2006.01) |
| ***C23C 10/56*** | (2006.01) |
| ***C23C 10/58*** | (2006.01) |
| ***C23C 24/08*** | (2006.01) |
| ***C23C 28/02*** | (2006.01) |

(52) U.S. Cl.

CPC ..... *C23C 10/32* (2013.01); *C23C 10/50* (2013.01); *C23C 10/56* (2013.01); *C23C 10/58* (2013.01); *C23C 10/60* (2013.01); *C23C 24/08* (2013.01); *C23C 28/021* (2013.01); *C23C 28/022* (2013.01)

(56) References Cited

U.S. PATENT DOCUMENTS

| | | | | |
|---|---|---|---|---|
| 4,261,742 | A | 4/1981 | Coupland et al. | |
| 4,346,137 | A | 8/1982 | Hecht | |
| 4,526,814 | A | 7/1985 | Shankar et al. | |
| 4,904,501 | A | 2/1990 | Davis | |
| 5,194,219 | A | 3/1993 | Baldi | |
| 5,492,726 | A * | 2/1996 | Rose | C23C 10/02 427/252 |
| 5,500,252 | A | 3/1996 | Meelu | |
| 5,674,610 | A | 10/1997 | Schaeffer et al. | |
| 6,110,262 | A * | 8/2000 | Kircher | C23C 10/30 106/14.21 |
| 6,387,194 | B1 | 5/2002 | Zeigler et al. | |
| 6,491,769 | B1 | 12/2002 | Smith et al. | |
| 6,503,340 | B1 | 1/2003 | Gold et al. | |
| 6,884,524 | B2 * | 4/2005 | Ackermann | C23C 10/02 427/374.1 |
| 7,824,738 | B2 | 11/2010 | Smith et al. | |
| 8,262,812 | B2 | 9/2012 | Helmick et al. | |
| 9,587,302 | B2 * | 3/2017 | Tang | C23C 10/20 |
| 2005/0265851 | A1 | 12/2005 | Madhava et al. | |
| 2006/0046091 | A1 * | 3/2006 | Madhava | C23C 10/58 428/689 |
| 2006/0093849 | A1 * | 5/2006 | Farmer | C23C 30/00 428/651 |
| 2006/0141283 | A1 * | 6/2006 | Madhava | C23C 10/58 428/651 |
| 2007/0272331 | A1 | 11/2007 | Strasser et al. | |
| 2009/0317658 | A1 | 12/2009 | Narita | |
| 2010/0151125 | A1 * | 6/2010 | Kool | C23C 10/18 427/226 |
| 2012/0060721 | A1 | 3/2012 | Kool et al. | |
| 2013/0115097 | A1 | 5/2013 | Berger | |
| 2014/0004372 | A1 | 1/2014 | Collins et al. | |
| 2014/0271220 | A1 | 9/2014 | Leggett | |
| 2015/0197841 | A1 | 7/2015 | Tang et al. | |
| 2015/0197842 | A1 | 7/2015 | Tang et al. | |
| 2017/0198382 | A1 * | 7/2017 | Tang | C23C 10/10 |

FOREIGN PATENT DOCUMENTS

| | | | |
|---|---|---|---|
| EP | 2631325 | A2 | 8/2013 |
| FR | 2559508 | A1 | 8/1985 |
| GB | 2401117 | A | 11/2004 |
| WO | 9807806 | A1 | 2/1998 |

OTHER PUBLICATIONS

Harada, Yoshio; Application of Chromium Diffusion Coating to Gas Turbine Blades Firing Residual Oils; Studies on Chromium Diffusion Coating of Nickel Superalloys (Part 6). Journal of the Metal Finishing Society of Japan, vol. 23, No. 9 (1972) pp. 509-514.

Bernstein, Henry L.; High Temperature Coatings for Industrial Gas Turbine Users; Proceedings of the 28th Turbomachinery Symposium, pp. 179-188.

* cited by examiner

METHODS OF APPLYING CHROMIUM DIFFUSION COATINGS ONTO SELECTIVE REGIONS OF A COMPONENT

RELATED APPLICATIONS

This application is a continuation of and claims the benefit of priority to U.S. application Ser. No. 14/592,382, filed on Jan. 8, 2015, now U.S. Pat. No. 9,587,302, which in turn claims the benefit of priority to U.S. provisional application Ser. No. 61/927,210 filed on Jan. 14, 2014, the disclosures of which are incorporated by reference herein in their respective entireties.

FIELD OF THE INVENTION

The present invention generally relates to novel and improved methods for applying chromium diffusion coatings onto selective regions of a component.

BACKGROUND OF THE INVENTION

A gas turbine engine consists of several components. During operation, the components of the gas turbine engine are typically exposed to harsh environments that can damage the turbine components. Environmental damage can occur in various modes, including damage as a result of heat, oxidation, corrosion, hot corrosion, erosion, wear, fatigue or a combination of several degradation modes.

Today's turbine engine is designed and operated in such a way that the environmental conditions and consequently the types of environmental damages in different regions of the various components of the turbine can vary significantly from one another. As a result, an individual turbine engine component often requires several coating systems to protect the underlying base materials of the component.

As an example, FIG. 1 shows the various sections of a typical turbine blade. The turbine blade has several sections, including a platform, an airfoil extending upwardly from the platform, a shank extending downwardly from the platform, a root extending downwardly form the shank, and internal cooling passages located insides the root, shank and airfoil. The platform has a top side adjacent to the airfoil and a bottom side adjacent to the shank.

In service, the airfoil and platform operate at the hottest regions of the turbine blades, and are therefore subject to oxidation degradation. Consequently, protection of the base materials of the airfoil regions and the top platform surface generally requires an oxidation-resistant coating, such as a diffusion aluminide coating and/or a MCrAlY overlay coating. These oxidation-resistant coatings are capable of forming a slowing-growing and adherent alumina scale. The scale provides a barrier between the metallic substrate and the environment. A thermal barrier coating can optionally be applied as top coat over the oxidation-resistant coating to further reduce metal temperature and increase service life of the component.

In contrast to the airfoil and platform, the other regions of the turbine blade, including the regions under the platform, shank, root and internal cooling passages, are exposed during service to relatively lower temperatures and the accumulation of corrosive particulates. Because these regions had previously been exposed to temperatures and conditions at which environmental damage did not have a tendency to occur, protective coatings were not generally required. However, as today's turbine blades continue to be exposed to increasingly higher operating temperatures, particulates accumulated on the surface have started to melt and cause type II hot corrosion attack, which can lead to premature failure of the turbine blade. Type II hot corrosion conditions generally require a chromium diffusion coating instead of a diffusion aluminide coating for protection.

The vanes are subject to similar attack to the blades, as the vanes are generally made from similar materials to the blades, and also may have cooling channels.

As can be seen, different regions of a turbine blade are susceptible to different types of damages. Adequate protection therefore requires selectively applying different protective coating systems to various components of the turbine blade. In particular, applying chromizing coatings locally onto only those regions of the turbine blade susceptible to hot corrosion attack is required.

However, conventional coating processes have their limitations for successfully applying chromizing coatings onto only selected regions of the component. For instance, conventional chromizing processes, such as pack chromizing and vapor phase chromizing, are not capable of forming a chromium diffusion coating onto selective regions of a turbine component without utilizing a customized diffusion-stop-off masking apparatus or post-coating treatment. Diffusion-stop-off masking is defined as the apparatus or technique which is used to prevent the chromium diffusion into substrate surface where no chromium diffusion coating is required.

Pack chromizing processes require a powder mixture including (a) a metallic source of chromium, (b) a vaporizable halide activator, and (c) an inert filler material such as aluminum oxide. Parts to be coated are first entirely encased in the pack materials and then enclosed in a sealed chamber or retort. The retort is then heated in a protective atmosphere to a temperature between about 1400-2100° F. for about 2-10 hours to allow Cr to diffuse into the surface. However, a complex and customized diffusion-stop-off masking apparatus is required to prevent chromide coating deposition at desired locations. Furthermore, pack chromizing processes require an in-contact relation between the chromium source and the metallic substrate. Pack chromizing is generally not effective to coat inaccessible or hard-to-reach regions, such as the surfaces of internal cooling passages of turbine blades. Moreover, undesirable residuals coatings can form. These residual coatings are difficult to remove from the cooling air holes and internal passages, and restriction of air flow may occur. Therefore, pack chromizing is not effective to selectively coat the surfaces of the internal cooling passages.

Vapor phase chromizing processes are also problematic. A vapor phase chromizing process involves placing the parts to be coated in a retort in an out-of-contact relationship with a chromium source and halide activator. Although a vapor phase process can effectively coat the surface of internal cooling passages, the entire surface is undesirably coated. As a result, the turbine blade needs to be masked along those regions where no chromizing coating is required. However, masking is challenging and often does not entirely conceal regions of the blade intended to be masked. Consequently, special post-coating treatments such as machining, grit blasting, or chemical treatments are required to remove the excess chromizing coating where no chromizing coating is required. Such post-coating treatments are generally non-selective and result in undesirable loss of the substrate material. The material loss can lead to changes in critical dimensions of turbine components and lead to premature structural dimension. Additionally, special care is typically required during post-coating treatments to prevent damage to the substrate or any chromizing coating not removed.

The problems of utilizing a pack or vapor phase chromizing process are exacerbated as the geometry of certain components of the turbine component become more complex, such as the regions under the platform, shank, root and internal cooling passages.

In view of the drawbacks of existing chromizing processes, there is a need for a new generation chromizing process that can produce a chromizing coating in a controlled and accurate manner on selective regions of a component, thereby minimizing masking requirements for areas where no coatings are required, reducing material waste and raw material consumption and minimizing exposure to hazardous materials in the workplace. Other advantages and applications of the present invention will become apparent to one of ordinary skill in the art.

SUMMARY OF THE INVENTION

In a first aspect of the present invention, a method for producing a localized and platinum-group-metal (PGM) modified chromium diffusion coating onto selected regions of a substrate, comprising the steps of: depositing a first platinum-group-metal (PGM) layer onto the surface of a substrate, said first (PGM) layer consisting of at least one element selected from the group consisting of platinum, iridium, rhodium, palladium and any combination thereof; providing a chromium-containing slurry; applying the chromium-containing slurry onto localized surfaces of said PGM layer of the substrate; curing the slurry; heating the cured slurry in a protective atmosphere to a predetermined temperature for a predetermined duration; generating chromium-containing vapors; diffusing chromium from said chromium-containing vapors into said localized surfaces of said PGM layer of the substrate to form the PGM modified chromium diffusion coating, said coating having a surface enrichment of both the chromium and the PGM, and further wherein said coating has a microstructure characterized by a substantial reduction in nitride and oxide inclusions and reduced levels of α-Cr phase in comparison to a conventional chromizing processes.

In a second aspect of the present invention, a method for producing a localized platinum-group-metal (PGM) modified chromium diffusion coating onto a first region of a substrate and a localized PGM-modified aluminide diffusion coating onto a second region of a substrate, comprising the steps of:

depositing a first platinum-group-metal (PGM) layer onto the first region of the substrate, said PGM layer consisting of at least one element selected from the group consisting of platinum, iridium, rhodium, palladium, and any combination thereof; providing a chromium-containing slurry; applying the chromium-containing slurry onto the first region of said PGM layer of the substrate, wherein said step of applying the chromium-containing slurry is characterized by an absence of diffusion-stop-off masking; providing an aluminum-containing material; heating the chromium-containing slurry and the aluminum-containing material in a protective atmosphere to a predetermined temperature for a predetermined duration; diffusing chromium into the first region; diffusing aluminum into the second region in the absence of diffusion-stop-off masking; forming the localized PGM modified chromium diffusion coating along the first region, said PGM modified chromium diffusion coating having a surface enrichment of both chromium and PGM and further wherein said coating has a microstructure characterized by a substantial reduction in nitride and oxide inclusions and reduced levels of α-Cr phase in comparison to conventional chromizing processes; and forming the localized PGM modified aluminide-diffusion coating along the second region.

In a third aspect, a method for producing a localized PGM modified chromium diffusion coating, and a localized PGM-modified aluminide diffusion coating onto selected regions of a blade simultaneously, said method comprising the steps of: depositing a first platinum-group-metal (PGM) layer onto a shank of the blade, said PGM layer consisting of at least one element selected from the group consisting of platinum, iridium, rhodium, palladium, and any combination thereof; providing a chromium-containing slurry; applying the chromium-containing slurry onto an external region of the shank of the blade, to create a partially coated blade; providing aluminum-containing material within the retort; loading the partially coated blade into the retort; heating the partially coated blade; generating aluminum containing vapors and chromium containing vapors; diffusing chromium from the chromium-containing vapors into the external region of the shank of the blade; diffusing aluminum from the aluminum-containing vapors into an airfoil of the blade; forming the localized and PGM-modified chromium diffusion coating along the shank, said chromium diffusion coating having a surface enrichment of both chromium and PGM and further wherein said coating has a microstructure characterized by a substantial reduction in nitride and oxide inclusions and reduced levels of α-Cr phase in comparison to conventional chromizing processes; and forming the localized PGM-modified aluminide-diffusion coating along the airfoil.

In a fourth aspect, a method for producing a platinum-group-metal (PGM) modified chromium diffusion coating onto selected regions of a substrate, comprising the steps of: providing a chromium-containing slurry; applying the chromium-containing slurry onto localized surfaces of the substrate; curing the slurry; heating the cured slurry in a protective atmosphere to a predetermined temperature for a predetermined duration; generating chromium-containing vapors; diffusing the chromium from said chromium-containing vapors into said localized surfaces to form the chromium diffusion coating, said coating having a microstructure characterized by a substantial reduction in nitride and oxide inclusions and reduced levels of α-Cr phase in comparison to conventional chromizing processes; depositing a PGM layer onto said chromium diffusion coating, said PGM layer consisting of at least one element selected from the group consisting of platinum, iridium, rhodium, palladium, and any combination thereof; performing diffusion treatment in a protective atmosphere to a predetermined temperature for a predetermined duration, and diffusing the PGM into said chromium diffusion coating; and producing said PGM-modified chromium diffusion coating onto the selected regions of the substrate, wherein said selected regions correspond to the localized surfaces.

The invention may include any of the following aspects in various combinations and may also include any other aspect of the present invention described below in the written description.

BRIEF DESCRIPTION OF THE DRAWINGS

The objectives and advantages of the invention will be better understood from the following detailed description of the preferred embodiments thereof in connection with the accompanying figures wherein like numbers denote same features throughout and wherein.

DETAILED DESCRIPTION OF THE INVENTION

Figure 1:
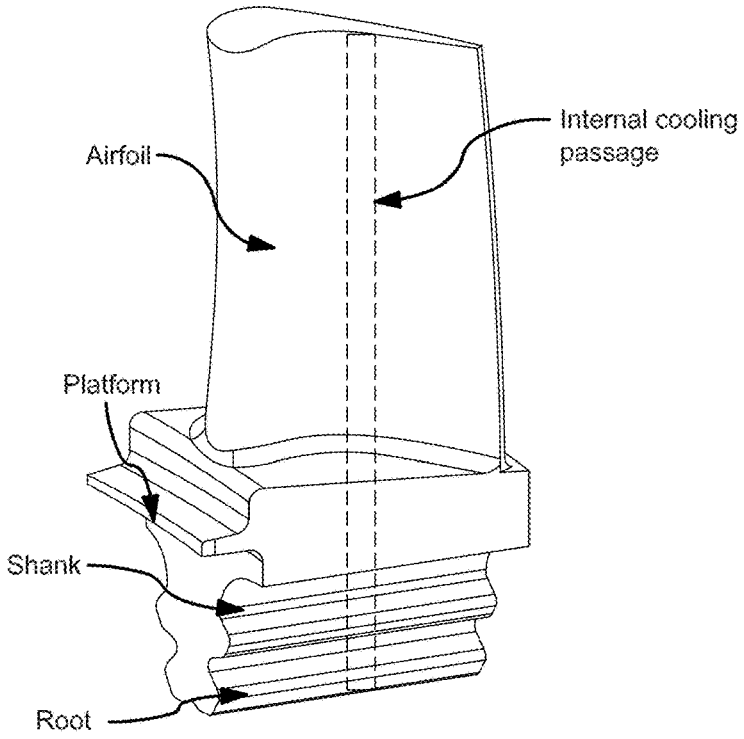
FIG. 1 shows a conventional turbine blade.

The objectives and advantages of the invention will be better understood from the following detailed description of the preferred embodiments thereof in connection. The present disclosure relates to novel and improved methods for applying chromium diffusion coatings onto selective regions of a component. The disclosure is set out herein in various embodiments and with reference to various aspects and features of the invention.

The relationship and functioning of the various elements of this invention are better understood by the following detailed description. The detailed description contemplates the features, aspects and embodiments in various permutations and combinations, as being within the scope of the disclosure. The disclosure may therefore be specified as comprising, consisting or consisting essentially of, any of such combinations and permutations of these specific features, aspects, and embodiments, or a selected one or ones thereof.

In all of the embodiments of the present invention, the terms "chromizing slurry" and "chromizing coating" will refer to those chromium-containing compositions as more fully described in U.S. Provisional Patent Application Ser. No. 61/927,180, filed concurrently on Jan. 14, 2014, and which is hereby incorporated by reference in its entirety. As more fully described therein, the chromizing coatings produced from such a chromizing slurry composition are unique and characterized by significantly reduced levels of nitride and oxide inclusions, along with lower α-chromium phases, compared to those chromizing coatings produced by conventional chromizing processes. As a result, the coatings have superior resistance to corrosion, erosion and fatigue in comparison to chromizing coatings produced by conventional pack, vapor or slurry processes.

The improved formulation is based, at least in part, upon the selected combination of specific halide activators and buffer materials within the slurry formulation. The slurry composition comprises a chromium source, a specific class of halide activator, a specific buffer material, a binder material and a solvent. The slurry composition comprises a chromium source in a range from about 10% to about 90% of the slurry; a halide activator in a range from about 0.5% to about 50% of the chromium source, a buffer material ranging from about 0.5% to about 100% of the chromium source; a binder solution in a range from about 5% to about 50% of the slurry in which the binder solution includes a binder and a solvent. An optional inert filler material may be provided that ranges from about 0% to about 50% of the slurry weight. In a preferred embodiment, the chromium source is in a range from about 30% to about 70%; the halide activator is in a range from about 2% to about 30% of the chromium source, the buffer material is in a range from about 3% to about 50% of the chromium source; the binder solution in a range from about 15% to about 40% of the slurry weight; and the optional inert filler material is in a range from about 5% to about 30% of the slurry.

Generally speaking, the chromium slurry comprises a chromium source, a specific halide activator and a binder solution. The chromium slurry further comprises a specific metallic powder or powder mixture which can lower the chemical activity of chromium in the slurry and getter residual nitrogen and oxygen during coating process. Further details of the chromizing slurry and chromizing coating compositions are described in U.S. Provisional Patent Application Ser. No. 61/927,180, filed concurrently on Jan. 14, 2014.

In accordance with the principles of the present invention, the chromium diffusion coatings of the present invention are locally applied to selected regions of metallic substrates in a controlled manner, in comparison to conventional chromizing processes, and further in a manner that produces less material waste and does not require diffusion-stop-off masking. Unless indicated otherwise, it should be understood that all compositions are expressed as weight percentages (wt %).

The slurry chromizing process is considered to be a chemical vapor deposition process. Upon heating to elevated temperature, the chromium source and the halide activator in the slurry mixture react to form volatile chromium halide vapor. Transport of the chromium halide vapor from the slurry to the surface of the alloy to be coated takes place primarily by the gaseous diffusion under the influence of chemical potential gradient between the slurry and the alloy surface. Upon reaching the alloy surface, these chromium halide vapors react at the surface and deposit chromium, which diffuses into the alloy to form the coating.

One embodiment of the present invention utilizes locally applying the chromium slurry composition onto a gas turbine blade (as shown in FIG. 1). Suitable methods include brushing, spraying, dipping, dip-spinning or injection. The specific method of application depends, at least in part, on the viscosity of the slurry composition as well as the geometry of the components. The chromizing slurry composition is applied onto any one or more of the regions of the blade susceptible to type II corrosion attack, such as, a surface of the shank, root, under platform and internal cooling passages. Complex and customized tooling and diffusion stop-off masking, as typical and known to be utilized for many pack processes, are not required, thereby simplifying the overall chromizing process. In general, application of approximately 0.02-0.1 inches of chromizing slurry ensures adequate coverage without the use of excessive amounts of slurry compositions, thereby minimizing the use of raw materials. Having applied the chromizing slurry, the slurry is subject to a heat cycle in a protective atmosphere for a predetermined temperature and duration to allow the chromium to diffuse into the localized regions of the component. After diffusion treatment, any remaining slurry residues along the localized regions can be removed by various methods, including wire blush, oxide grit burnishing, glass bead, high-pressure water jet or other conventional methods. Slurry residues typically comprise unreacted slurry compositional materials. The removal of any slurry residue is conducted in such a way as to prevent damage to the underlying chromizing surface layer. The resultant chromizing coating contains insubstantial amounts of oxide and nitride inclusions along with lower levels of alpha-chromium phase, compared to a conventional pack chromizing process. The average chromium content in the chromium diffusion coating is about 15-50 wt %, and more preferably 25-40 wt %.

Compared to pack chromizing, the slurry method of the present invention allows the slurry to be locally applied only onto only those regions where chromizing coating is required. Furthermore, unlike pack chromizing, no complex and customized tooling and diffusion stop-off masking is necessary.

Figure 2:
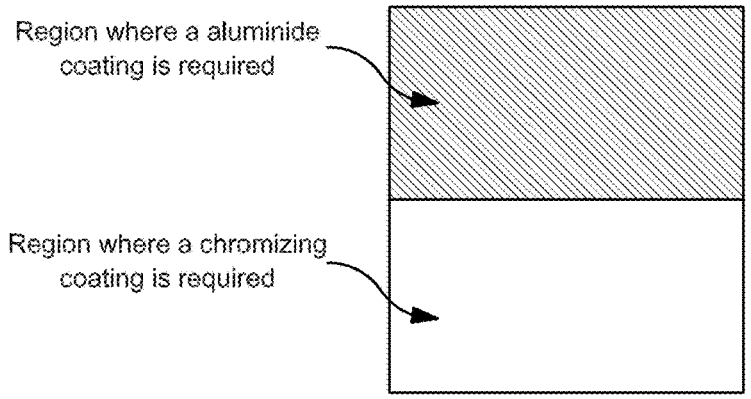
FIG. 2 shows a schematic of selectively applying a local aluminide coating and a local chromizing coating onto selective regions of a substrate.

Another embodiment of the present invention provides for application of different coatings onto selective regions of a component. Specifically, an aluminide coating can be locally applied in conjunction with the chromizing coating. FIG. 2 shows the resultant coating system that is produced by the methods of the present invention. A chromizing coating is located on the bottom region of the substrate where corrosion resistance is required, and an aluminide coating is located on the top region where oxidation resistance is needed. Any conventional aluminide coating process such as vapor phase, slurry or chemical vapor deposition aluminization processes may be employed to produce the aluminde diffusion coating. As an example, an aluminide slurry coating process may be utilized with a conventional aluminide slurry such as SermAlcote™ 2525, which is commercially made and sold by Praxair Surface Technologies, Inc. (Indianapolis, Ind.). The aluminde slurry can be applied in a manner as known in the art, and as described in U.S. Pat. No. 6,110,262, which is hereby incorporated by reference in its entirety.

Figure 3:
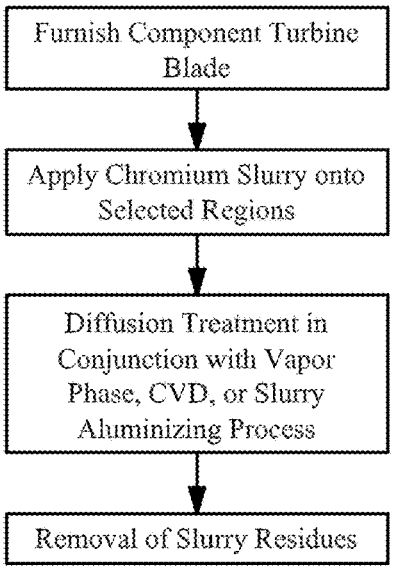
FIG. 3 shows a block flow diagram, in accordance with principles of the present invention, for an approach of simultaneously forming a chromium diffusion coating on the surface of selected regions of a turbine blade while forming an aluminide coating on the surface of other regions of the turbine blade.

In a preferred embodiment of the present invention, FIG. 3 shows a block flow diagram for simultaneously forming in a single step a localized chromium diffusion coating on the surface of selected regions of a turbine blade while forming a localized aluminide coating on the surface of other regions of the turbine blade. One or more chromium slurry layers are applied onto selected regions of the blade which are susceptible to type II corrosion attack, such as the surface of the shank, root, under platform and internal cooling passages. Brushing, spraying, dipping, dip-spinning or injection may be used to apply the chromizing slurry at a thickness sufficient to ensure adequate coverage of the surfaces. Diffusion stop-off masking is not required by virtue of the ability to selectively apply the chromizing slurry onto only the desired surfaces of the blade.

After applying the chromizing slurry, a conventional vapor phase, slurry or chemical vapor deposition aluminizing process may be utilized with suitable aluminum source materials as known in the art. Diffusion treatment may occur under an elevated temperature ranging from about 1000-1150° C. in a protective atmosphere for up to 24 hours, and more preferably about 2-16 hours. Upon heating to the elevated temperature, aluminum halide vapors are generated from aluminide source materials, transport to the surface of the alloy, and form aluminide coatings where no chromizing slurry is applied. These aluminum halide vapors can also reach the region of the outer surface of the chromizing slurry. However, these aluminum halide vapors react with chromium source in the slurry mixture to form chromium halide vapors, thereby leading to a substantial decrease in the partial pressure of aluminum halide vapor through the slurry thickness towards the alloy surface. Meanwhile, within the chromizing slurry, chromium halide vapors were partially generated via chemical reactions of the chromium source and the halide activator in the slurry mixture. As a result, chromium halide vapors, as opposed to aluminum halide vapors, tend to prevail and preferentially occupy the localized regions where the chromizing slurry has been applied. The existence of chromium halide vapors in such regions enables formation of a chromide coating that is thermodynamically favored over an aluminide coating. Consequently, the localized aluminide diffusion coating is locally produced in a controlled manner along those surfaces where no chromizing slurry had been applied, while a localized chromium diffusion coating is simultaneously produced along other regions.

In a preferred embodiment, the chromium slurry is provided and applied onto a region of the turbine blade susceptible to type II corrosion (i.e., shank). No special tooling for diffusion-stop-off masking is required. The partially slurry-coated blade is then loaded into a vapor phase aluminizing retort and heated in a protective atmosphere to carry out a vapor-phase aluminzation process. The chromium and aluminizing coatings are simultaneously formed during the heat cycle. The aluminizing coating forms along regions susceptible to oxidation (i.e., airfoil) while the chromizing coating forms along relatively cooler regions susceptible to corrosion (i.e., shank) without employing diffusion stop-off masking. Any excess residue may be removed from the coated regions.

Figure 4:
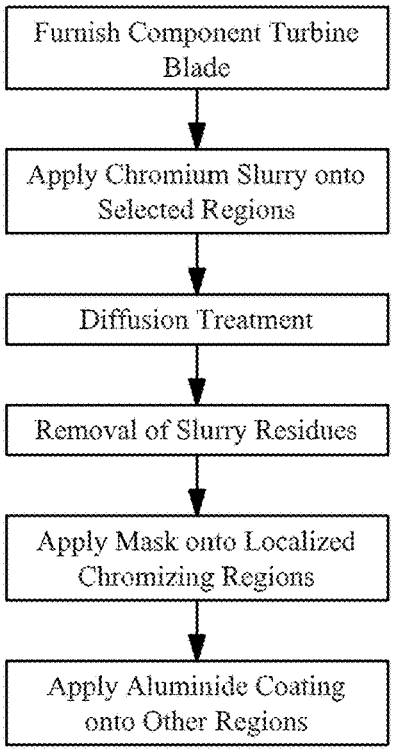
FIG. 4 shows a block flow diagram, in accordance with principles of the present invention, of a 2-step approach that initially forms a chromium diffusion coating on the surface of selected regions of a turbine component and thereafter forms an aluminide coating on the surface of other regions of the component.

Other variations are contemplated. For example, the aluminide coating can be applied separately after formation of the chromizing coating. Prior to the aluminizing process, an aluminizing mask is applied to the chromizing region that was previously produced by the localized slurry chromizing process of the present invention. This mask prevents the deposition of aluminide coating over the chromizing coating during the aluminizing process, as inadvertent deposition of the aluminide coating over the chromizing coating can weaken the corrosion resistance of the chromizing coating. In this regard, FIG. 4 shows a 2-step approach of a block flow diagram in accordance with principles of the present invention. Alternatively, the aluminide coating can be applied before formation of the chromizing coating.

Figure 5:
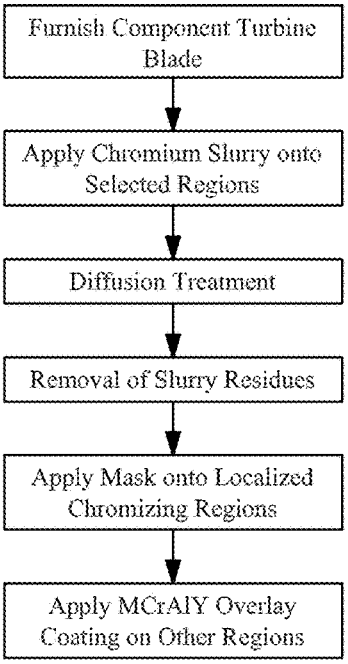
FIG. 5 shows a block flow diagram of a 2-step approach for applying chromium diffusion coating on the surface of selected regions of a turbine component and then applying a MCrAlY overlay coating onto the surfaces of other selected regions of the component.

Still further, other types of coatings may be utilized in the present invention. As an example, after diffusion treatment of the chromium slurry-coated part onto those selected regions of the turbine blade susceptible to corrosion attack and removal of any residual coating, a second MCrAlY overlay coating can be applied to the airfoil by any conventional processes, such as air plasma spray, LPPS or HVOF. Prior to applying the MCrAlY coating, a mask is applied to the chromizing region that was previously produced by the localized slurry chromizing process of the present invention. FIG. 5 shows a block flow diagram of such a 2-step approach for the coating process.

In another example, to further enhance the coating's resistance to type II hot corrosion attack, prior to or after a localized slurry chromizing process of the present invention, a layer of a platinum-group-metal (PGM) can be applied to produce a PGM-modified chromium diffusion coating onto selected regions of a substrate. The PGM layer consists of at least one element, which may include platinum, iridium, rhodium, and palladium. The PGM layer can be applied using known methods, including by way of example and without limitation, electroplating or physical vapor deposition. The resultant localized and PGM-modified chromium diffusion coating has a surface enrichment with both chromium and PGM. The coating has a microstructure characterized by a substantial reduction in nitride and oxide inclusions and reduced levels of α-Cr phase in comparison to conventional chromizing processes.

One embodiment in accordance with the present invention includes producing a localized and PGM-modified chromium diffusion coating by deposition of a PGM layer followed by a slurry-based chromizing coating process. A PGM layer is initially deposited onto the surface of a substrate, preferably by electroplating. After electroplating but prior to the slurry chromizing process, an optional vacuum heat treatment can be employed at about 1500-2100° F. for about 1 to 10 hours to enhance the bond strength between the PGM layer and the substrate. A slurry-based chromizing process is then employed to deposit chromium onto the selected regions of the substrate containing the surface PGM layer by the following steps. A chromium-containing slurry is provided. The slurry is applied onto the selected regions of the substrate containing the PGM layer. The slurry is cured. Next, the cured slurry is heated in a protective atmosphere to a predetermined temperature for a predetermined duration to allow the chromium to diffuse into the localized regions of the substrate. After diffusion treatment, any remaining slurry residues along the localized regions can be removed by known methods, including, for example, wire brush and oxide grit burnishing. The resultant localized and PGM-modified chromium diffusion coating has a surface layer enriched with both chromium and PGM. The surface chromium and PGM enrichment layer has a microstructure characterized by a substantial reduction in nitride and oxide inclusions and reduced levels of α-Cr phase in comparison to conventional chromizing processes.

In another embodiment, the localized and PGM-modified chromium diffusion coating is produced by first depositing a localized chromizing coating onto selected regions of a substrate followed by deposition of a PGM layer onto selected regions of the substrate. A slurry-based chromizing process is first employed to deposit chromium onto the selected regions of the substrate by the following steps. The slurry is applied onto the selected regions of the substrate. The slurry is cured. Next, the cured slurry is heated in a protective atmosphere to a predetermined temperature for a predetermined duration to allow the chromium to diffuse into the localized regions of the substrate. After diffusion treatment, any remaining slurry residues along the localized regions can be removed by known methods, such as wire blush and oxide grit burnishing. After completion of the chromizing process, a PGM layer is deposited onto the chromium diffusion coating, preferably by electroplating. Masking can be used during electroplating of the PGM layer if the PGM layer is not desired on some regions of the substrate. After the electroplating, a vacuum diffusion treatment can be performed at 1500-2100° F. for 1 to 10 hours to enhance the bond strength between PGM layer and the chromium coating. Contrary to conventional processes and coatings, the resultant localized and PGM-modified chromium diffusion coating of the present invention has a surface layer enriched with both chromium and PGM. Further, the surface chromium and PGM enrichment layer exhibits a microstructure characterized by a substantial reduction in nitride and oxide inclusions and reduced levels of α-Cr phase in comparison to conventional chromizing processes.

Another embodiment of present invention provides a method of producing a localized PGM modified chromium diffusion coating on one region of a substrate and a localized PGM modified aluminide coating onto another region of a substrate. A PGM layer is first electroplated onto the surface of a substrate followed by an optional vacuum heat treatment at 1500-2100° F. for 1 to 10 hours. Next, a chromium-containing slurry is provided. The slurry is applied onto the first region of the substrate containing the PGM layer. The slurry is then cured. Next, an aluminum-containing material is provided. The chromium-containing slurry and the aluminum-containing material are heated in a protective atmosphere to a predetermined temperature for a predetermined duration to allow the chromium and aluminum to selectively diffuse into the surface of the substrate, respectively. After diffusion treatment, any remaining slurry residues along the localized regions can be removed by known methods, for example, wire brush and oxide grit burnishing. A PGM-modified chromium diffusion coating is produced on the first region of the substrate where chromium-containing slurry is applied. A PGM-modified aluminide coating is produced on the second region of the substrate where no chromium-containing slurry is applied. The resultant PGM-modified chromium diffusion coating has a surface layer enriched with both chromium and PGM. The surface chromium and PGM enrichment layer has a microstructure characterized by a substantial reduction in nitride and oxide inclusions and reduced levels of α-Cr phase in comparison to conventional chromizing processes. Applicants have demonstrated the ability to create such a coating in Example 2, the methods and results of which are provided below.

Example 1

A turbine blade as shown in FIG. 1 was selectively coated with a chromizing slurry composition and an aluminide coating utilizing the one-step approach shown in FIG. 3. The chromizing slurry composition was prepared comprising an aluminum fluoride activator, chromium powder, nickel powder, and an organic binder solution. The slurry was prepared by mixing the following: 75 g chromium powder, −325 mesh; 20 g aluminum fluoride; 4 g Klucel™ hydroxypropylcellulose; 51 g deionized water; 25 g nickel powder and 25 g alumina powder.

The chromizing slurry composition was applied to selected surfaces of a shank as shown in FIG. 1 by dipping the blade into the slurry. The turbine blade was made of a single-crystal nickel-based superalloy which has a nominal composition of, by weight, about 7.5% Co, 7.0% Cr, 6.5% Ta, 6.2% Al, 5.0% W, 3.0% Re, 1.5% Mo, 0015% Hf, 0.05% C, 0.004% B, 0.01% Y and the balance nickel. The slurry coating was then allowed to dry in an oven at 80° C. for 30 minutes followed by curing at 135° C. for 30 minutes.

The slurry coated part was loaded into a typical vapor phase aluminizing retort which contained a source of Cr—Al nuggets and aluminum fluoride powder. The Cr—Al nugget and aluminum fluoride powder were located in the bottom of coating retort. The slurry coated part was placed out of contact with both Cr—Al nugget and aluminum fluoride. After purging the retort with flowing argon for 1 hour, the retort was heated to 2010° F. in an argon atmosphere and held for 4 hours to allow the chromium and aluminum to selectively diffuse into the airfoil of the specimen, respectively. Upon the completed diffusion treatment, the specimen was cooled to ambient temperature under argon atmosphere and the slurry residues were removed from the specimen surface by a light grit-blasting operation.

Figure 6A:
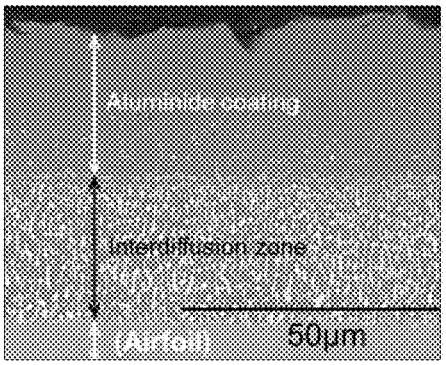
FIG. 6*a* shows a cross-sectional microstructure of an aluminide coating locally applied on an airfoil.
Figure 6B:
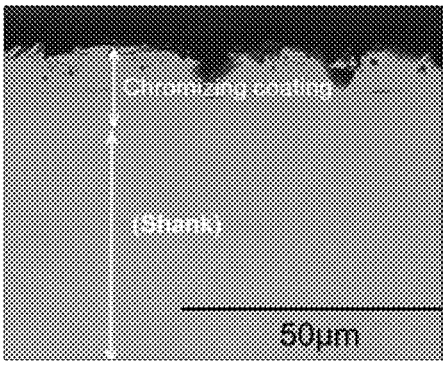
FIG. 6*b* shows a cross-sectional microstructure of a chromium diffusion coating locally applied on the shank, whereby both coatings were produced by the method described in Example 1 utilizing the inventive approach shown in FIG. 3.

Results of the coating are shown in FIGS. 6*a* and 6*b*. The specimen had its upper half or airfoil region coated with the aluminide coating, as shown in FIG. 6*a*, to resist high-temperature oxidation and its bottom half or shank region coated with a chromium enriched layer, as shown in FIG. 6*b*, to resist low-temperature hot corrosion. The chromium diffusion coating had an insignificant amount of oxide and nitride inclusions compared to conventional pack or vapor phase chromizing processes. The coating was observed to substantially free of α-Cr phase and the average chromium concentration in chromium diffusion coating was greater than 25 wt. %.

Example 2

A Ni-alloy substrate was selectively coated with a platinum-modified chromium diffusion coating in one region and selectively coated with a platinum-modified aluminide coating in a second region, by first depositing a platinum layer followed by a chromizing process in conjunction with an aluminizing process.

Figure 7A:
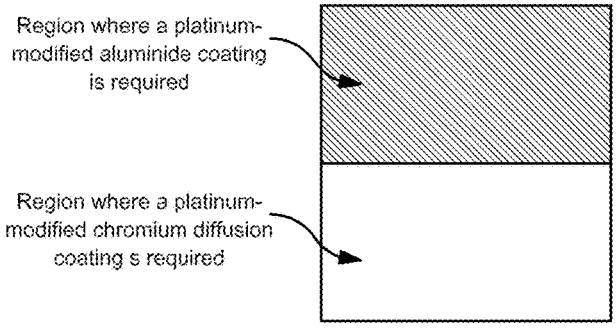
FIG. 7*a* shows a schematic of selectively applying a platinum-modified chromium diffusion coating on one portion of a substrate, and a platinum-modified aluminide coating on a second portion of the substrate.

A Ni-alloy coupon was provided, where half of the coupon required a platinum-modified chromium diffusion coating and the other half of the coupon required a platinum-modified aluminide coating. A schematic of the resultant coupon is shown in FIG. 7*a*. The Ni-alloy substrate had a nominal composition of, by weight, about 9.6% Co, 6.5% Co, 6.5% Ta, 5.6% Al, 1% Ti, 0.6% Mo, 3% Re and the balance nickel.

The entire surface of the alloy coupon was first deposited with a 4 micrometer thick platinum layer by electroplating. After electroplating, a vacuum diffusion treatment was performed at 1700° F. for 2 hours to promote the inter-diffusion between the platinum layer and the foregoing elements from the Ni-alloy substrate.

Having created the platinum layer, a chromizing slurry was prepared comprising an aluminum fluoride activator, chromium powder, nickel powder and an organic binder solution. The slurry was prepared by mixing the following: 75 g chromium powder, −325 mesh; 20 g aluminum fluoride; 4 g Klucel™ hydroxypropylcellulose; 51 g deionized water; 25 g nickel powder and 25 g alumina powder. The chromizing slurry composition was applied to the bottom surface of the coupon where platinum-modified chromium diffusion coating was required, as shown in FIG. 7*a*. The slurry was then allowed to dry in an oven at 80° C. for 30 minutes, followed by curing at 135° C. for 30 minutes. The slurry coated part was then loaded into a typical vapor phase aluminizing retort which contained a source of Cr—Al nuggets and aluminum fluoride powder. The Cr—Al nugget and aluminum fluoride powder were located in the bottom of coating retort. The slurry coated part was placed out of contact with both Cr—Al nugget and aluminum fluoride. After purging the retort with flowing argon for 1 hour, the retort was heated to 1975° F. in an argon atmosphere and held for 6 hours to allow the chromium and aluminum to selectively diffuse into the surface of the coupon, respectively. Upon the completed diffusion treatment, the specimen was cooled to ambient temperature under argon atmosphere and the slurry residues were removed from the specimen surface by a light grit-blasting operation.

Figure 7B:
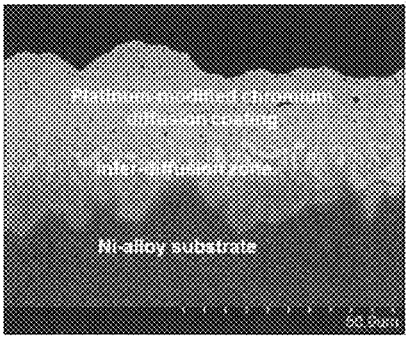
FIG. 7*b* shows a cross-sectional microstructure of a nickel-alloy substrate in which the bottom portion of the substrate of FIG. 7*a* was coated with a platinum modified chromium diffusion coating.
Figure 7C:
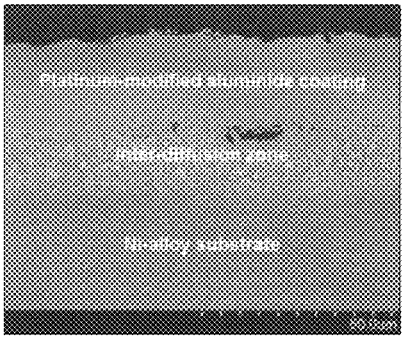
FIG. 7*c* shows a cross-sectional microstructure of the nickel alloy substrate of FIG. 7*a* in which the top portion of the substrate was coated with a platinum modified aluminide coating.

Results of the coating are shown in FIGS. 7*b* and 7*c*. The coupon had its upper half coated with the platinum modified aluminide coating, as shown in FIG. 7*c*, to resist high-temperature oxidation attack and its bottom half coated with a platinum modified chromium diffusion coating, as shown in FIG. 7*b*, to resist type II hot corrosion attack. The platinum modified chromium diffusion coating exhibited enrichment with both chromium and platinum. The platinum modified chromium diffusion coating had an insignificant amount of oxide and nitride inclusions compared to conventional pack or vapor phase chromizing processes. The coating was observed to be substantially free of α-Cr phase and the average chromium concentration in chromium diffusion coating was greater than 15 wt. %.

The method and resultant coating of present invention represent a significant improvement from conventional methods which are not able to apply and create a localized platinum-modified chromium diffusion coating onto one region of a substrate and a localized platinum-modified aluminide coating on another region of the substrate.

The chromizing methods of the present invention represent a substantial improvement over conventional Cr diffusion coatings produced from pack, vapor or slurry processes. As has been shown, the present invention offers a unique method for locally applying chromizing slurry formulations with an optional second coating along other selected regions. The slurries of the present invention are advantageous in that they can be selectively applied with control and accuracy onto localized regions of the substrate by simple application methods, including brushing, spraying, dipping or injecting. Further, the control and accuracy of applying the chromizing and other coating can occur in a single step without diffusion-stop-off masking. On the contrary, conventional pack and vapor phase processes cannot locally generate chromium coatings along selected regions of a substrate. As a result, these conventional coatings require difficult masking techniques which typically are not effective in concealing those regions along the metallic substrate not desired to be coated.

The ability for the present invention to locally apply slurry formulations to form coatings has the added benefit of significantly lower material waste. As such, the present invention can conserve overall slurry material and reduce waste disposal, thereby creating higher utilization of the slurry constituents. The reduction in the raw materials required for coating minimizes exposure of hazardous materials in the workplace.

Still further, unlike pack and vapor phase processes, the modified slurry formulations of the present invention can be used to form the improved chromium coatings onto various parts having complex geometries and intricate internals. Pack processes have limited versatility, as they can only be applied to parts having a certain size and simplified geometry.

It should be understood that in addition to gas blades, the principles of the present invention may be utilized to coat any suitable substrate requiring controlled application of chromizing coatings. In this regard, the methods of the present invention can protect a variety of different substrates that are utilized in other applications. For example, the chromizing coatings as used herein may be locally applied in accordance with the principles of the present invention onto stainless steel substrates which do not contain sufficient chromium for oxidation resistance. The chromizing coatings form a protective oxide scale along the stainless steel substrate. Additionally, the present invention, unlike conventional processes, is effective in locally coating selected regions of substrates having internal sections with complex geometries.

While it has been shown and described what is considered to be certain embodiments of the invention, it will, of course, be understood that various modifications and changes in form or detail can readily be made without departing from the spirit and scope of the invention. It is, therefore, intended that this invention not be limited to the exact form and detail herein shown and described, nor to anything less than the whole of the invention herein disclosed and hereinafter claimed.

The invention claimed is:

1. A method for producing a localized and platinum-group-metal (PGM) modified chromium diffusion coating onto selected regions of a substrate, comprising the steps of:

depositing a first platinum-group-metal (PGM) layer onto the surface of a substrate, said first (PGM) layer consisting of at least one element selected from the group consisting of platinum, iridium, rhodium, palladium and any combination thereof;

providing a chromium-containing slurry;

applying the chromium-containing slurry onto localized surfaces of said PGM layer of the substrate;

curing the slurry;

heating the cured slurry in a protective atmosphere to a predetermined temperature for a predetermined duration;

generating chromium-containing vapors;

diffusing chromium from said chromium-containing vapors into said localized surfaces of said PGM layer of the substrate to form the PGM modified chromium diffusion coating, said coating having a surface enrichment of both the chromium and the PGM, and further wherein said coating has a microstructure characterized by a substantial reduction in nitride and oxide inclusions and reduced levels of α-Cr phase in comparison to a conventional chromizing processes.

2. The method of claim 1, wherein said method comprises locally applying a second coating onto the substrate.

3. The method of claim 2, wherein said second coating comprises an aluminide coating.

4. The method of claim 2, wherein said second coating comprises a MCrAlY coating.

5. The method of claim 1, wherein the step of applying the slurry comprises brushing, spraying, dipping, dip-spinning, injection, or any combination thereof.

6. The method of claim 1, wherein said localized surfaces are subject to corrosion attack.

7. A method for producing a localized platinum-group-metal (PGM) modified chromium diffusion coating onto a first region of a substrate and a localized PGM-modified aluminide diffusion coating onto a second region of a substrate, comprising the steps of:

depositing a first platinum-group-metal (PGM) layer onto the first region of the substrate, said PGM layer consisting of at least one element selected from the group consisting of platinum, iridium, rhodium, palladium, and any combination thereof;

providing a chromium-containing slurry;

applying the chromium-containing slurry onto the first region of said PGM layer of the substrate, wherein said step of applying the chromium-containing slurry is characterized by an absence of diffusion stop-off masking;

providing an aluminum-containing material;

heating the chromium-containing slurry and the aluminum-containing material in a protective atmosphere to a predetermined temperature for a predetermined duration;

diffusing chromium into the first region;

diffusing aluminum into the second region in the absence of diffusion stop-off masking;

forming the localized PGM modified chromium diffusion coating along the first region, said PGM modified chromium diffusion coating having a surface enrichment of both chromium and PGM and further wherein said coating has a microstructure characterized by a substantial reduction in nitride and oxide inclusions and reduced levels of α-Cr phase in comparison to conventional chromizing processes; and forming the localized PGM modified aluminide-diffusion coating along the second region.

8. The method of claim 7, wherein said first region is subject to corrosion attack.

9. The method of claim 7, wherein said second region is subject to oxidation attack.

10. The method of claim 7, wherein the step of applying the chromium-containing slurry comprises brushing, spraying, dipping, dip-spinning, injection or any combination thereof.

11. The method of claim 7, wherein said localized PGM modified chromium diffusion coating and said localized PGM modified aluminide diffusion coating are formed simultaneously during diffusion treatment.

12. The method of claim 7, wherein the substrate is a gas turbine blade and said first region comprises a shank.

13. The method of claim 11, wherein said second region comprises an airfoil.

14. A method for producing a localized PGM modified chromium diffusion coating, and a localized PGM-modified aluminide diffusion coating onto selected regions of a blade simultaneously, said method comprising the steps of:

depositing a first platinum-group-metal (PGM) layer onto a shank of the blade, said PGM layer consisting of at least one element selected from the group consisting of platinum, iridium, rhodium, palladium, and any combination thereof;

providing a chromium-containing slurry;

applying the chromium-containing slurry onto an external region of the shank of the blade, to create a partially coated blade;

providing aluminum-containing material within the retort;

loading the partially coated blade into the retort;

heating the partially coated blade;

generating aluminum containing vapors and chromium containing vapors;

diffusing chromium from the chromium-containing vapors into the external region of the shank of the blade;

diffusing aluminum from the aluminum-containing vapors into an airfoil of the blade;

forming the localized and PGM-modified chromium diffusion coating along the shank, said chromium diffusion coating having a surface enrichment of both chromium and PGM and further wherein said coating has a microstructure characterized by a substantial reduction in nitride and oxide inclusions and reduced levels of α-Cr phase in comparison to conventional chromizing processes; and forming the localized PGM-modified aluminide-diffusion coating along the airfoil.

15. The method of claim 14, wherein said chromium-containing slurry is locally applied and characterized by an absence of diffusion-stop-off masking.

16. The method of claim 14, wherein said localized diffusion coating forms in the absence of diffusion-stop-off masking.

17. A method for producing a platinum-group-metal (PGM) modified chromium diffusion coating onto selected regions of a substrate, comprising the steps of:

providing a chromium-containing slurry;

applying the chromium-containing slurry onto localized surfaces of the substrate;

curing the slurry;

heating the cured slurry in a protective atmosphere to a predetermined temperature for a predetermined duration;

generating chromium-containing vapors;

diffusing the chromium from said chromium-containing vapors into said localized surfaces to form the chromium diffusion coating, said coating having a microstructure characterized by a substantial reduction in nitride and oxide inclusions and reduced levels of α-Cr phase in comparison to conventional chromizing processes;

depositing a PGM layer onto said chromium diffusion coating, said PGM layer consisting of at least one element selected from the group consisting of platinum, iridium, rhodium, palladium, and any combination thereof;

performing diffusion treatment in a protective atmosphere to a predetermined temperature for a predetermined duration, and diffusing the PGM into said chromium diffusion coating; and producing said PGM-modified chromium diffusion coating onto the selected regions of the substrate, wherein said selected regions correspond to the localized surfaces.

* * * * *